US005801486A

United States Patent [19]

Johnson et al.

[11] Patent Number: 5,801,486

[45] Date of Patent: Sep. 1, 1998

[54] HIGH FREQUENCY FIELD EMISSION DEVICE

[75] Inventors: Scott V. Johnson; James E. Jaskie, both of Scottsdale, Ariz.

[73] Assignee: Motorola, Inc., Schaumburg, Ill.

[21] Appl. No.: 741,590

[22] Filed: Oct. 31, 1996

[51] Int. Cl.[6] ..... H01J 1/02

[52] U.S. Cl. ..... 313/495; 313/309; 313/336; 313/351

[58] Field of Search ..... 313/309, 336, 313/351, 495; 315/366

[56] References Cited

U.S. PATENT DOCUMENTS

| | | | |
|---|---|---|---|
| 5,124,664 | 6/1992 | Cade et al. | 313/309 |
| 5,150,019 | 9/1992 | Thomas et al. . | |
| 5,227,699 | 7/1993 | Busta . | |
| 5,243,252 | 9/1993 | Kaneko et al. | 313/309 |
| 5,355,093 | 10/1994 | Treado et al. . | |
| 5,497,053 | 3/1996 | Tang et al. . | |
| 5,666,019 | 9/1997 | Potter | 313/306 |

FOREIGN PATENT DOCUMENTS 0694948 of 0000 European Pat. Off. .

*Primary Examiner*—Vip Patel

*Attorney, Agent, or Firm*—Kathleen Anne Tobin; Eugene A. Parsons

[57] ABSTRACT

A high frequency field emission device (200, 400, 500, 600) includes a cathode (210, 410, 563, 610), a field emissive film (260, 460, 560, 660) formed on the cathode (210, 410, 563, 610), an anode (220, 420, 520, 620) spaced from the field emissive film (260, 460, 560, 660), and a control electrode (250, 450, 550, 650, 655) disposed between the anode (220, 420, 520, 620) and cathode (210, 410, 563, 610) for modulating or switching electron emission from the field emissive film (260, 460, 560, 660) according to a high frequency input signal signal.

3 Claims, 3 Drawing Sheets

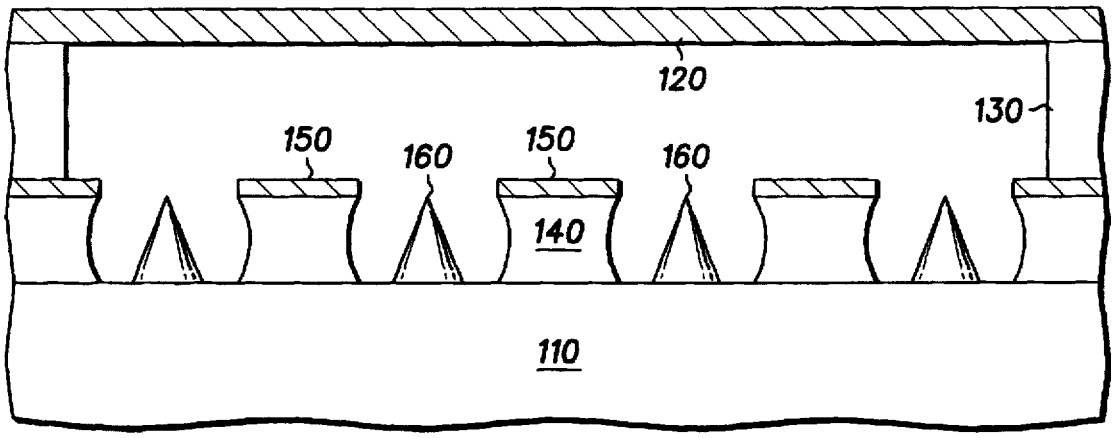
FIG. 1 100 - PRIOR ART -
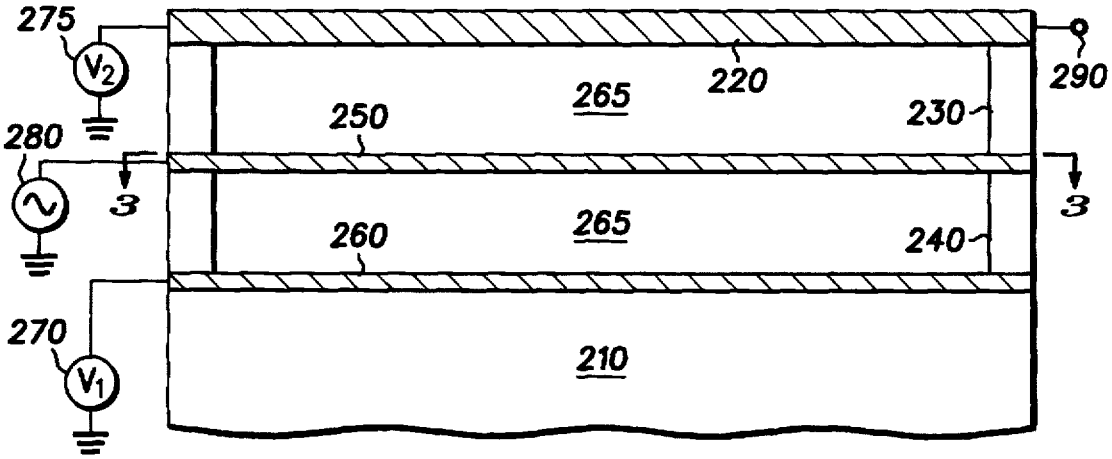
FIG. 2 200
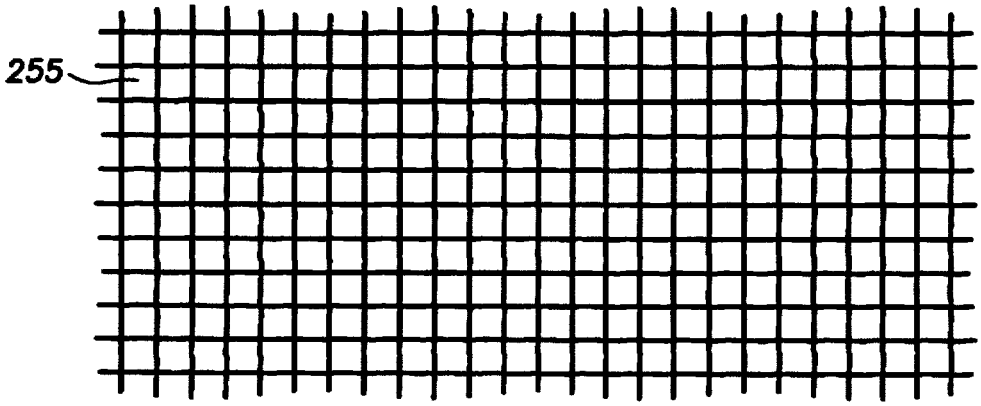
FIG. 3 250

HIGH FREQUENCY FIELD EMISSION DEVICE

FIELD OF THE INVENTION

The present invention pertains to the field of electronic grid devices for high frequency amplification and switching systems and, more specifically, to electronic grid devices pertaining to integrated circuits.

BACKGROUND OF THE INVENTION

Field emission devices for signal switching and amplification that utilize structures with one or more field emitters are known in the art. These prior art schemes utilize field emission structures, such as Spindt tips, which have sharp-featured geometries and which typically require highly elaborate, costly fabrication processes. Field emission devices used for high frequency signal modulation typically include triode configurations, including a cone-shaped emitter circumscribed by a proximate extraction gate control electrode that initiates and controls current flow from the tip of the field emitter toward and through the extraction gate. They further include an anode which collects the emitted electrons and is disposed within 200–5000 micrometers from the gate extraction electrode. The extraction gate control electrode is typically disposed within 0.1–1 micrometers from the tip of the cone-shaped emitter.

Prior art field emitter devices have several serious disadvantages which limit and complicate their use for high frequency signal amplifiers or for high frequency switching systems. One of these disadvantages is the high degree of complexity and concomitant cost of fabrication of cone-shaped field emitters. Typically, many steps are involved, requiring many pieces of process equipment to perform the various photolithographic steps. Another disadvantage is the high capacitance that exists between the closely configured gate extraction electrode and the field emitter. This close proximity is necessary to achieve low device turn-on potential, typically within the range of 60 to 100 Volts (??). This high input capacitance limits the high frequency performance of these devices due to capacitive reactance. Another disadvantage of known field emitter devices is the high gate leakage current that occurs at moderate collector potentials. The gate leakage current increases proportionately as collector potential decreases because the number of electrons that have their paths redirected from the gate to the collector diminishes. Still another disadvantage is high dynamic output resistance. This occurs because the field emission initiated by the extraction gate limits the number of electrons that can reach the collector, so that saturation of collector current develops with even moderate collector potentials. The high resulting output resistance makes efficient high frequency output coupling difficult when even small amounts of capacitive reactance are present in the output circuit. Another disadvantage of prior art high frequency amplification and switching systems includes the provision of low current densities thereby precluding optimal compactness of the device.

Thus, there exists a need for an improved high frequency field emission device, suitable for use in high frequency amplification and switching systems, which is simple to fabricate, has low input capacitance, and provides a greater current density.

Referring now to FIG. 1, there is depicted a schematic representation of a prior art field emission device (FED) 100. FED 100 includes a cathode plate 110, an anode plate 120, a spacer 130 disposed between cathode plate 110 and anode plate 120, a dielectric layer 140 disposed on an inner surface of cathode plate 110, a plurality of field emitters 160 formed within wells in dielectric layer 140, and a gate extraction electrode 150 formed on dielectric layer 140 and circumscribing field emitters 160. Cathode plate 110 and anode plate 120 are electrically conductive, and when appropriate potentials are applied thereto and to gate extraction electrode 150, electrons are caused to be emitted from the tips of field emitters 160. Electron extraction is initiated and controlled by the potential applied at gate extraction electrode 150. In order to limit power consumption, the distance between gate extraction electrode 150 and the emission tips of field emitters 160 is made very small, on the order of 0.1–1 micrometers. Typically, the height of dielectric layer 140 is on the order of 1 micrometer and is governed by processing considerations. The capacitance between gate extraction electrode 150 and field emitters 160/cathode plate 110 is a significant limitation of prior art FED 100 which precludes high frequency modulation or switching by gate extraction electrode 150 of the electron emission from field emitters 160. The capacitance per unit area of FED 100 is greater than about 3500 pF/cm$^2$, which is known to be unacceptable for switching or modulating applications with control signals having frequencies in the Ghz range that are applied to gate extraction electrode 150. This is due to the decrease in reactance of the capacitance between gate extraction electrode 150 and field emitters 160 with respect to increasing frequency of an input signal at gate extraction electrode 150. This capacitance is inversely proportional to the thickness of dielectric layer 140. Due to this micron-range thickness, the capacitance renders FED 100 unacceptable for use for high frequency amplification or switching applications wherein a control signal having a frequency in the range of $10^6$–$10^{10}$ Hertz is applied to gate extraction electrode 150. High frequency control signals are excessively loaded by the configuration of FED 100. Additionally, leakage currents through dielectric layer 140 act to further load down control signals applied to gate extraction electrode 150.

BRIEF DESCRIPTION OF THE DRAWINGS

Referring to the drawings:

FIG. 1 is a schematic representation of a prior art field emission device;

FIG. 2 is a schematic representation of an embodiment of a high frequency field emission device in accordance with the present invention;

FIG. 3 is a sectional view, taken along the section lines 3—3 of the high frequency field emission device of FIG. 2;

Referring now to FIG. 2, there is depicted a schematic representation of a high frequency field emission device 200 in accordance with the present invention. High frequency field emission device 200 includes a cathode 210, a field emissive film 260 formed on an inner surface of cathode 210, and an anode 220 spaced from field emissive film 260 to provide an interspace region 265 therebetween. High frequency field emission device 200 further includes a control electrode 250, which, in this particular embodiment, is positioned within interspace region 265 between cathode 210 and anode 220, and a pair of spacer frames 230, 240 which provide standoff between control electrode 250 and anode 220 and between control electrode 250 and cathode 210, respectively. Hermetic seals are formed and a vacuum on the order of $10^{-6}$ Torr is provided within interspace region 265. Cathode 210 may include a plate of glass upon which is deposited a conductive film, or it may include a copper substrate plated with nickel. Upon the conductive film, field emissive film 260 is formed. Field emissive film 260 includes a film of field emissive material. Suitable field emissive materials include diamond, diamond-like carbon, polycrystalline diamond, and other carbon-based and non-carbon-based emissive compositions which can be made as films. These field emissive films exhibit electronic emission at low field strengths and typically exhibit turn on fields on the order of 10 Volts per micron to produce current densities on the order of 1 mA/mm$^2$. The formation of diamond, diamond-like carbon, and polycrystalline diamond films is known in the art and includes, for example, chemical vapor deposition processes, such as PECVD of methane. Suitable carbon films may also be deposited on cathode 210 via cathodic arc deposition of a graphite source. The fabrication of polycrystalline diamond thin film is described in the following three publications, which are incorporated herein by reference: "Deposition of Diamond Films at Low Pressures and Their Characterization by Position Annihilation, Raman Scanning Electron Microscopy, and X-ray Photoelectron Spectroscopy", Sharma et al., *Applied Physics Letters*, vol. 56, 30 Apr., 1990, pp. 1781–1783; "Characterization of Crystalline Quality of Diamond Films by Raman Spectroscopy", Yoshi Kawa et al. *Applied Physics Letters*, vol. 55, 18 Dec., 1989, pp. 2608–2610; and "Characterization of Filament-Assisted Chemical Vapor Deposition Diamond Film Using Raman spectroscopy", Buckley et al., *Journal of Applied Physics*, vol. 66, 15 Oct., 1989, pp. 3595–3599. Clearly, it is established in the art that polycrystalline diamond films are realizable and may be formed on a variety of supporting substrate, such as, for example, silicon, molybdenum, copper, tungsten, titanium, and various carbides. In this particular embodiment, field emissive film 260 substantially covers the entire inner surface of cathode 210. A simple, single step deposition is involved in the formation of field emissive film 260. No further patterning steps are required. Spacer frames 230, 240 may include any suitable hard, insulative material, such as ceramic. Anode 220 includes an electrically and thermally conductive material that is suitable for use as a collector element, such as nickel or oxygen-free copper. In this particular embodiment, anode 220 is a flat plate and can be easily adapted to standard cooling apparati, such as a heat sink, heat pipe, or water clamp. In other embodiments of the present invention, the anode is disposed within the evacuated interspace region but does not comprise the external packaging element, and it may not include one continuous plate. Other collector/anode materials and configurations suitable for use in a high frequency field emission device in accordance with the present invention will be apparent to one skilled in the art. In this particular embodiment, control electrode 250 includes a gridded mesh which is gold plated. Control electrode 250 overlies field emissive film 260 and has contacts for applying a high frequency input signal thereto. The distance between control electrode 250 and field emissive film 260 is greater than 50 micrometers, preferably greater than 250 micrometers. The distance between field emissive film 260 and anode 220 is within of 1–4 millimeters. In the operation of high frequency field emission device 200, a potential source 270 is operably coupled to field emissive film 260 for applying an appropriate potential thereto. A high frequency input signal is applied to control electrode 250 by an ac signal source 280. A DC voltage source 275 is operably coupled to anode 220, which is maintained at a potential, within a range of about 1000–5000 volts, positive with respect to that provided at cathode 210 for extracting and collecting electrons from field emissive film 260. Control electrode 250 modulates/deflects the trajectories of electrons emitted from field emissive film 260, thereby modulating the electron flow in response to the high frequency input signal from ac signal source 280. The modulated electron flow is received by anode 220 and an output signal 290 is thereby generated. Diamond and diamond-like carbon films provide surface current densities which are much greater than the tip field emitters of the prior art. Thus, the dimensions of high frequency field emission device 200 can be made very compact. Additionally, the capacitance between control electrode 250 and field emissive film 260 is substantially less than that of prior art field emission triodes, such as FED 100 (FIG. 1), due to the greater inter-electrode distances. The reduction in capacitance is sufficient to render high frequency field emission device 200 useful for modulating the emission current according to a high frequency input signal. Additionally, the absence of a dielectric layer between the electrodes precludes leakage currents which would otherwise load down control signals that are applied to control electrode 250. The packaging of high frequency field emission device 200 may be made comparable to modern integrated circuit packages so that it is easily integrated into, for example, stripline and microstripline circuits.

Referring now to FIG. 3, there is depicted a sectional view of high frequency field emission device 200 taken along the section lines 3—3 of FIG. 2. FIG. 3 further illustrates the grid-like configuration of control electrode 250, which includes a plurality of apertures 255. Electrons emitted from field emissive film 260 travel through apertures 255 as regulated by the input voltage applied to control electrode 250. Electrons which are not deflected to a suitable extent by the high frequency input signal, are received by anode 220, thereby contributing to output signal 290. In other embodiments of the present invention, more than one control electrode is included, each control electrode including a coated mesh configuration and being spaced vertically, within the interspace region, from the other control electrode (s). In this manner, tetrodes and pentodes may be made.

Referring now to FIGS. 4 and 5, there are depicted cross-sectional (FIG. 4) and sectional (taken along the section line 5—5 in FIG. 4) views of a high frequency field emission device 400 in accordance with the present invention. High frequency field emission device 400 includes a cathode 410, a patterned field emissive film 460 formed on an inner surface 415 of cathode 410, and an anode 420 spaced from patterned field emissive film 460 to provide an interspace region 465 therebetween. High frequency field emission device 400 further includes a patterned control electrode 450, which includes a layer of patterned, highly conductive material formed on inner surface 415 between portions of patterned field emissive film 460, and a spacer frame 440 which provides standoff between cathode 410 and anode 420. The highly conductive material comprising patterned control electrode 450 may include a metal such as tungsten, molybdenum, or copper, which is formed by standard deposition and patterning techniques, known to one skilled in the art. Cathode 410 may include a plate of glass upon which is deposited a patterned conductive film which underlies patterned field emissive film 460, or it may include a copper substrate plated with a similary patterned layer of nickel. Upon this patterned conductive film, patterned field emissive film 460 is formed. Patterned field emissive film 460 includes a film of field emissive material, such as diamond, diamond-like carbon, as described with reference to FIG. 2. In this particular embodiment, patterned field emissive film 460 covers a portion of inner surface 415 of cathode 410. The sections of patterned field emissive film 460 are spaced from, and are alternately disposed with respect to, the sections of patterned control electrode 450. The distance between the adjacent sections is predetermined and is sufficient to preclude generation of excessive inter-electrode capacitance. Spacer frame 440 includes any suitable hard, insulative material, such as ceramic. Anode 420 includes an electrically and thermally conductive material that is suitable for use as a collector element, such as nickel or oxygen-free copper. Anode 420 is flat and can be easily adapted to standard cooling apparati, such as a heat sink, heat pipe, or water clamp. In the operation of high frequency field emission device 400, a DC voltage source 470 is operably coupled to patterned field emissive film 460 for applying an appropriate potential thereto. Additionally, patterned control electrode 450 is operably coupled to a high-frequency input signal source 480, as schematically depicted in FIG. 5. The distance between adjacent sections of control electrode 450 and field emissive film 460 is greater than 50 micrometers, preferably greater than 250 micrometers. The distance between field emissive film 460 and anode 420 is within of 1–4 millimeters. In the operation of high frequency field emission device 400, a low voltage is applied field emissive film 460 by DC voltage source 470; a high frequency input signal is applied to control electrode 450 by high-frequency input signal source 480; and anode 420 is maintained at a potential, within a range of about 1000–5000 volts, (positive with respect to that provided at cathode 410) by a DC voltage source 475, thereby extracting and collecting electrons from field emissive film 460. Control electrode 450 modulates/deflects the electrons emitted from field emissive film 460, thereby modulating the electron flow in response to the high frequency input signal from ac signal source 480. The modulated electron flow is received by anode 420 and an output signal 490 is thereby generated. The distance between patterned field emissive film 460 and anode 420 is suitable for realizing, at patterned field emissive film 460, an electric field having suitable strength to provide electron emission therefrom, as indicated by arrows in FIG. 4. This distance is great enough to realize a suitably low inter-electrode capacitance. The appropriate field strength is dependent upon the identity of the emissive material comprising patterned field emissive film 460. Very short response times and electron transit times may be realized by making the distance between anode 420 and cathode 410 very small, and, simultaneously, making the thickness of each portion of patterned control electrode 450 very thin. Diamond and diamond-like carbon films provide current densities which are much greater than those of tip field emitters of the prior art. Thus, the dimensions of high frequency field emission device 400 can be made very compact. Additionally, the capacitance between patterned control electrode 450 and patterned field emissive film 460 is substantially less than that of prior art field emission triodes, such as FED 100 (FIG. 1), due to the greater inter-electrode distances. This inter-electrode capacitance may be designed to be less than about 50 pF/cm$^2$, which is substantially less than that of prior art FED 100 (FIG. 1). The reduction in capacitance is sufficient to render high frequency field emission device 400 useful for high frequency amplification and switching systems. Additionally, the absence of a dielectric layer between the electrodes precludes leakage currents which would otherwise load down control signals that are applied to patterned control electrode 450. In other embodiments of the present invention, the patterning of patterned control electrode 450 and/or patterned field emissive film 460 may include patterns other than parallel strips.

Referring now to FIG. 6, there is depicted a cross-sectional view of a high frequency field emission device 500 in accordance with the present invention. High frequency field emission device 500 includes a substrate 510 having an inner surface 515, a plurality of dielectric members 562 attached to inner surface 515, a cathode 563 formed on the upper surfaces of dielectric members 562, a patterned field emissive film 560 formed on cathode 563, and a patterned control electrode 550. Patterned control electrode 550 is formed on inner surface 515, between dielectric members 562, and includes a layer of patterned highly conductive material, which may include a metal such as tungsten, molybdenum, or copper, and is formed by standard deposition and patterning techniques, known to one skilled in the art. High frequency field emission device 500 further includes an anode 520 spaced from patterned field emissive film 560 to extract and collect electrons therefrom, as indicated by arrows in FIG. 6, and a spacer frame 540 which provides standoff between substrate 510 and anode 520. Substrate 510 may include a glass plate, or it may include a copper substrate, if heat dissipation is required. Patterned field emissive film 560 includes a film of field emissive material, such as diamond, diamond-like carbon, or others, as described with reference to FIG. 2. A suitable method for making high frequency field emission device 500 includes first forming patterned control electrode 550 on inner surface 515 and, thereafter, depositing a layer of a dielectric material, such as silicon dioxide, over the entire patterned surface of substrate 510. Then, a layer of metal suitable for cathode 563 is deposited upon the dielectric layer. Upon the metal layer is formed a layer of the diamond or diamond-like carbon or other predetermined field emissive material. Thereafter, using appropriate etchants, a plurality of wells 566 are formed by selectively etching through the layer of field emissive material, the metal layer, and the dielectric layer, to expose patterned control electrode 550. The area of patterned control electrode 550 is preferably minimized to reduce inter-electrode capacitances. In this particular embodiment, the inter-electrode capacitance is reduced by the separation provided by the height of dielectric members 562. The inter-electrode capacitance is also reduced by the lateral separation of patterned control electrode 550 and patterned field emissive film 560, in the manner described with reference to FIGS. 4 and 5. The height of dielectric members 562 is sufficient to provide the appropriate capacitive characteristics and may be made substantially greater than the inter-electrode separations found in prior art field emission devices. The resulting inter-electrode capacitance may be designed to be less than about 50 pF/cm$^2$, which is substantially less than that of prior art FED 100 (FIG. 1). Additionally, because field emissive films, such as made from diamond-like carbon, generate current fluxes that are several orders of magnitude greater than those of prior art tip emitters, devices in accordance with the present invention can accommodate and afford greater distances between adjacent portions of the field emissive film and the control electrode, thereby realizing improved capacitance characteristics over the prior art without compromising compactness of the device and simultaneously provide greater output currents for a device of comparable dimensions. In the operation of high frequency field emission device 500, a low voltage is applied cathode 563 by DC voltage source (not shown); a high frequency input signal is applied to patterned control electrode 550 by high-frequency input signal source (not shown); and anode 520 is maintained at a potential, within a range of about 1000–5000 volts, (positive with respect to that provided at cathode 563) by a DC voltage source (not shown), thereby extracting and collecting electrons from patterned field emissive film 560. Patterned control electrode 550 modulates/deflects the electrons emitted from patterned field emissive film 560, thereby modulating the electron flow in response to the high frequency input signal. The modulated electron flow is received by anode 520 and an output signal 590 is thereby generated.

Referring now to FIG. 7, there is depicted a cross-sectional view of a high frequency field emission device 600 in accordance with the present invention. High frequency field emission device 600 comprises a tetrode device and includes a vacuum tube configuration, wherein elements are generally cylindrically shaped and share a common cylindrical axis. A cathode 610 is centrally disposed therein and comprises a nickel-plated copper cylinder. A field emissive film 660 is formed on the outer surface of cathode 610. Field emissive film 660 is made from a carbon-based field emissive material known to yield field emissive films, such as diamond-like carbon, diamond, or amorphous carbon, as described with reference to FIG. 2. Non-carbon-based field emissive films may also be used to form field emissive film 660. A first control electrode 650 is generally cylindrically shaped and is centered along the axis of cathode 610. First control electrode 650 includes a gold-plated mesh and is operably coupled to a voltage source (not shown). In this particular configuration, first control electrode 650 is spaced about 0.23 millimeters from field emissive film 660. A second control electrode 655 is also generally cylindrically shaped and is centered along the axis of cathode 610 as well. Second control electrode 655 includes a gold-plated mesh which is operably coupled to another voltage source (not shown). Second control electrode 655 is spaced about 0.9 millimeters from field emissive film 660. An anode 620 is similarly configured and is the outermost element. Anode 620 is made from an electrically and thermally conductive material that is suitable for use as a collector element, such as nickel or oxygen-free copper. Anode 620 is spaced about 3.6 millimeters from field emissive film 660. In one voltage configuration, field emissive film 660 is held at ground potential; first control electrode 650 is held at about −50 Volts; second control electrode 655 has a high frequency input applied thereto in the range of 300–500 Volts; and anode 620 is connected to a voltage source providing a voltage on the order of 1500 Volts, to effect extraction of electrons from field emissive film 660. For this voltage configuration, a maximum current on the order of 800 amperes per square centimeter is supplied by high frequency field emission device 600. This current value is about 2000 times greater than a similarly configured conventional thermionic vacuum tube tetrode which includes an oxide coating electron source. An additional improvement over prior art thermionic devices includes the omission of a heated filament. The breakage of the heated filament is the primary failure mechanism of these prior art devices. Due to the simple fabrication methods of the field emissive film included therein, high frequency field emission devices in accordance with the present invention may include many types of configurations, as exemplified by, but not limited to, the embodiments described herein. Additionally, due to the high current densities and low required field strengths of the field emissive films of the present device, inter-electrode distances can be made greater than those typical of conical/tip emitters of the prior art. These greater inter-electrode distances provide the distinct advantage of lower inter-electrode capacitances, thereby providing improved performance for high frequency applications.

A high frequency field emission device in accordance with the present invention may be used for radio frequency applications, such as broadcast, land mobile, aeronautical, and space transmitters. Other applications include AF power amplifiers, video drivers, and other high voltage applications. It may be used in both stripline and microstripline circuits using many existing RF semiconductor design techniques.

Figure 4:
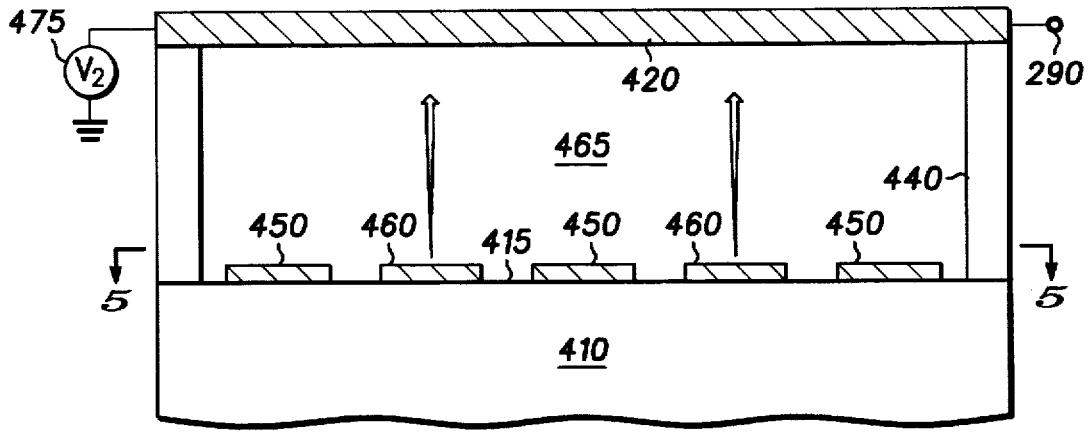
FIG. 4 is a cross-sectional view of another embodiment of a high frequency field emission device in accordance with the present invention.
Figure 5:
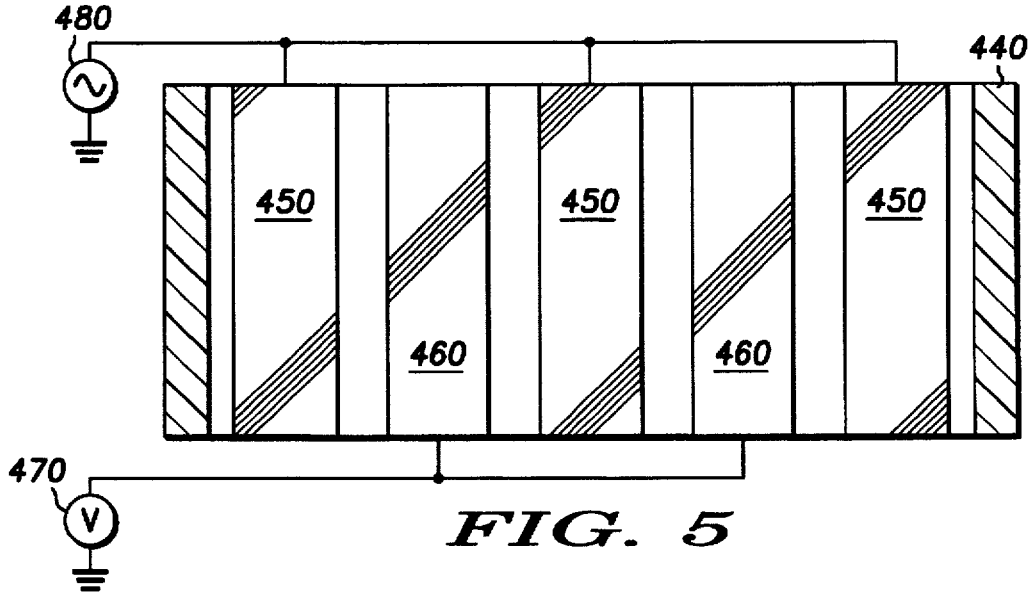
FIG. 5 is a sectional view, taken along the section lines 5—5 of the high frequency field emission device of FIG. 4.
Figure 6:
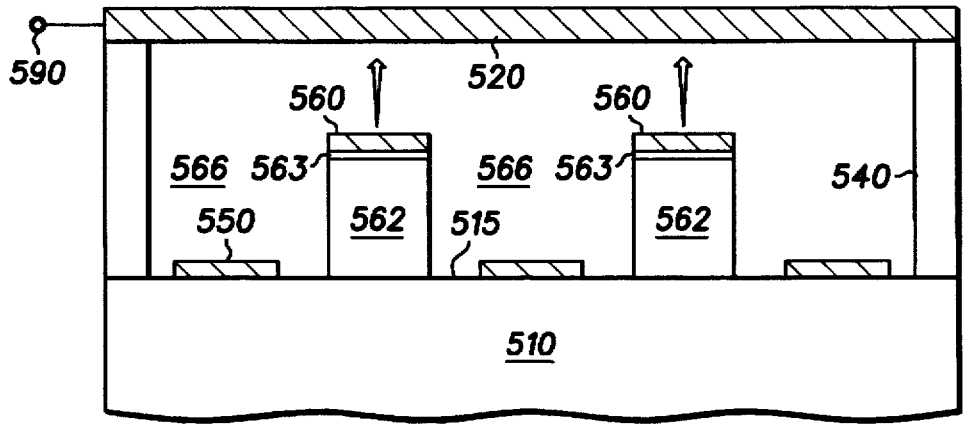
FIG. 6 is a cross-sectional view of another embodiment of a high frequency field emission device in accordance with the present invention.
Figure 7:
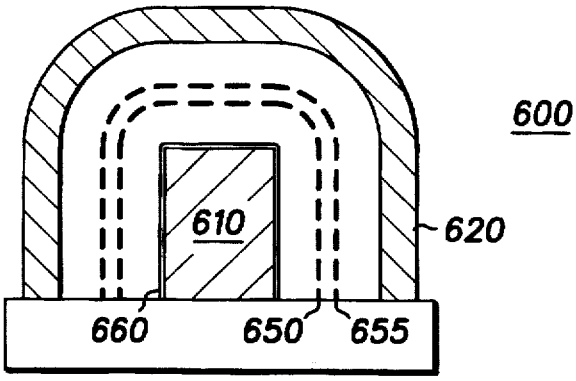
FIG. 7 is a cross-sectional view of another embodiment of a high frequency field emission device in accordance with the present invention.
Figure 8:
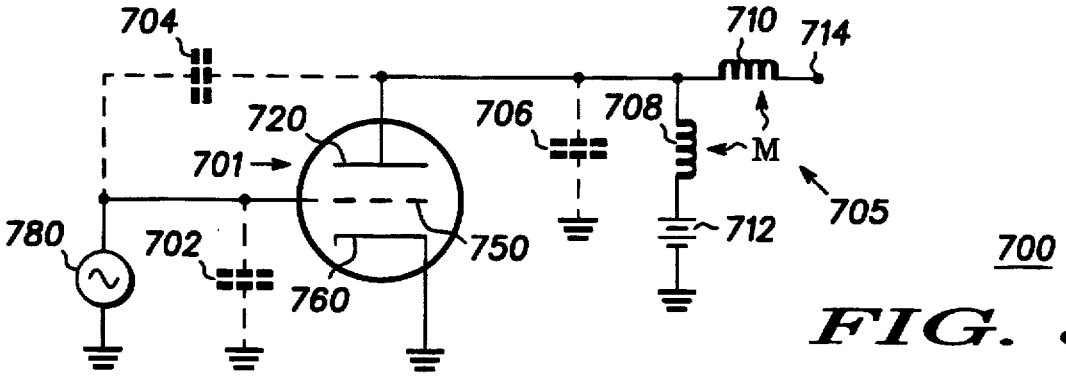
FIG. 8 is a schematic representation of a high frequency circuit application of a high frequency field emission device in accordance with the present invention.

Referring now to FIG. 8, there is depicted a schematic representation of a high frequency circuit application 700 of a high frequency field emission device 701 in accordance with the present invention. Within high frequency circuit application 700, high frequency field emission device 701 is used as an efficient power amplifier. High frequency circuit application 700 includes a simple impedance transformation network 705 to provide high potential gain with little attenuation due to capacitive reactance. As depicted in FIG. 8, a high-frequency input signal source 780 is coupled to a control electrode 750 of high frequency field emission device 701. A field emissive film 760 of high frequency field emission device 701 is maintained at ground potential. The input capacitance, or emitter-control electrode capacitance, is represented by a capacitor 702, which is shown in dashed lines between control electrode 750 and ground. The anode-control electrode capacitance is represented by a capacitor 704, which is shown in dashed lines between an anode 720 of high frequency field emission device 701 and control electrode 750. The output capacitance is represented by a capacitor 706 between anode 720 and ground. Impedance transformation network 705 includes an inductor 708 and an inductor 710 having a mutual coupling factor M and a common connection to anode 720. The other side of inductor 708 is connected to a high potential anode source 712 that provides sufficient positive potential relative to field emissive film 760 to produce electron emission. The other side of inductor 710 is connected to a high impedance output terminal 714. As is well known in the art, for any frequency output signal wherein inductors 708, 710 have a suitable degree of mutual conductance, not considering losses, the signal output potential developed at high impedance output terminal 714 is equal to the product of the signal output potential developed at anode 720 and the turns ratio of inductor 710 to inductor 708. The turns ratio may be made very high to develop a high output signal potential at high impedance output terminal 714.

Figure 9:
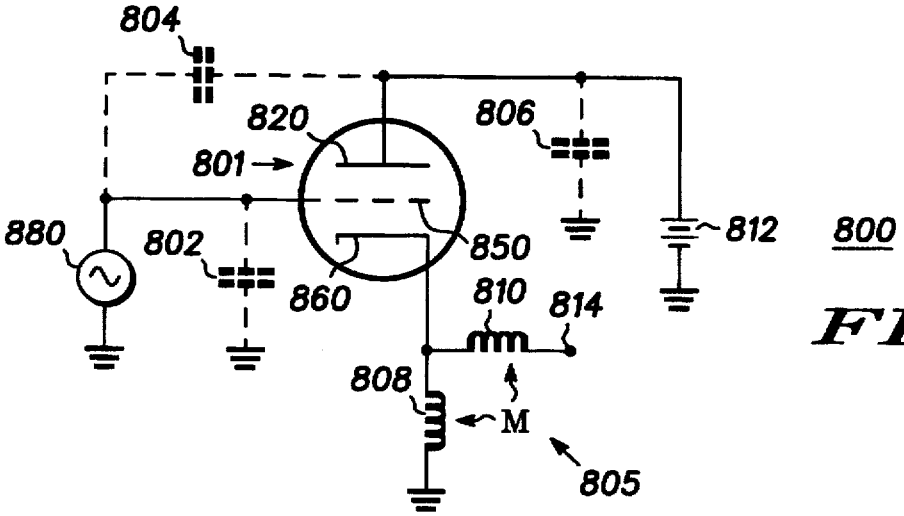
FIG. 9 is a schematic representation of another high frequency circuit application of a high frequency field emission device in accordance with the present invention.

Referring now to FIG. 9, there is depicted a schematic representation of a high frequency circuit application 800 of a high frequency field emission device 801 in accordance with the present invention. High frequency circuit application 800 includes an emitter-follower amplifier configuration wherein the input signal from a high-frequency input signal source 880 and an output signal, from an output terminal 814, are in phase, so that no neutralization is required for high frequency signal power amplification. This configuration is a simple rearrangement of the components shown in FIG. 8. A high potential anode source 812 is connected directly to an anode 820 of high frequency field emission device 801 to hold anode 820 at a potential supplied by high potential anode source 812. This configuration provides the benefit that destabilizing positive feedback cannot be fed from anode 820 back to a control electrode 850 of high frequency field emission device 801 through the capacitive reactance of a capacitor 804. A simple impedance transformation network 805 includes an inductor 808 and an inductor 810 having a mutual coupling factor M and a common connection to a field emissive film 860 of high frequency field emission device 801. The other side of inductor 808 is connected to ground, and the other side of inductor 810 is connected to output terminal 814. Due to the low output impedance of this configuration, a high value of turns ratio may be used, thereby providing a high power output gain while avoiding significant losses due to stray capacitances in inductors 808, 810.

A high frequency field emission device in accordance with the present invention may be used as a high frequency modulated electron source for pumped solid state lasers. It may also be used as a deflection amplifier wherein potential is alternatively applied to selected portions of the control electrode to deflect electrons toward predetermined portions of the anode, the switching action within the control electrode being at high frequency. It may also be used in a magnetron wherein the modulated electron ribbon is further acted upon by a magnetic field provided between the control electrode and the anode, the magnetic field being at right angles to the electric field applied between the cathode and the anode.

While we have shown and described specific embodiments of the present invention, further modifications and improvements will occur to those skilled in the art. We desire it to be understood, therefore, that this invention is not limited to the particular forms shown, and we intend in the appended claims to cover all modifications that do not depart from the spirit and scope of this invention.

We claim:

1. A high frequency field emission device comprising:

a cathode having a major surface; a field emissive film being deposited on the major surface of the cathode for emitting electrons;

an anode spaced from the field emissive film and designed to receive electrons emitted by the field emissive film; and a control electrode disposed in operable spaced relationship with respect to the field emissive film so that an inter-electrode capacitance therebetween is suitable for realizing electron emission which is responsive to a high frequency input signal acting at the control electrode, the high frequency input signal having a frequency within a range of $10^6$–$10^{10}$ Hertz, and wherein the distance between the field emissive film and the control electrode is greater than 50 micrometers.

2. The high frequency field emission device as claimed in claim 1 wherein the distance between the field emissive film and the control electrode is greater than 250 micrometers.

3. The high frequency field emission device as claimed in claim 1 wherein the field emissive film comprises diamond.

* * * * *